US010420967B2

(12) United States Patent
Poldmaa

(10) Patent No.: US 10,420,967 B2
(45) Date of Patent: Sep. 24, 2019

(54) SHUTTLE DEVICE

(71) Applicant: Safetylink Pty Ltd, Hawks Nest, NSW (AU)

(72) Inventor: Arvo Poldmaa, Hawks Nest (AU)

(73) Assignee: Safetylink Pty Ltd, Hawks Nest, NSW (AU)

( * ) Notice: Subject to any disclaimer, the term of this patent is extended or adjusted under 35 U.S.C. 154(b) by 0 days.

(21) Appl. No.: 15/756,499

(22) PCT Filed: Aug. 26, 2016

(86) PCT No.: PCT/AU2016/050790

§ 371 (c)(1),
(2) Date: Feb. 28, 2018

(87) PCT Pub. No.: WO2017/035574

PCT Pub. Date: Mar. 9, 2017

(65) Prior Publication Data

US 2018/0243594 A1 Aug. 30, 2018

(30) Foreign Application Priority Data

Aug. 28, 2015 (AU) ..... 2015903497

(51) Int. Cl.
*A62B 35/00* (2006.01)
*E04G 21/32* (2006.01)

(52) U.S. Cl.
CPC ..... *A62B 35/0081* (2013.01); *A62B 35/0037* (2013.01); *A62B 35/0056* (2013.01);
(Continued)

(58) Field of Classification Search
CPC ..... A62B 35/0037; A62B 35/0056; A62B 35/0062; A62B 35/0081; A62B 35/0087
See application file for complete search history.

(56) References Cited

U.S. PATENT DOCUMENTS 4,790,410 A * 12/1988 Sharp ..... A62B 35/0056 182/12
6,125,766 A * 10/2000 Flux ..... A62B 35/0056 104/115

(Continued)

FOREIGN PATENT DOCUMENTS

GB 2388148 A 11/2003

OTHER PUBLICATIONS

International Searching Authority (ISA), International Search Report and Written Opinion for International Application No. PCT/AU2016/050790, dated Nov. 28, 2016, 8 pages, Australian Patent Office, Australia.

(Continued)

*Primary Examiner* — Colleen M Chavchavadze
(74) *Attorney, Agent, or Firm* — Alston & Bird LLP

(57) ABSTRACT

The present invention is directed to a shuttle device for a height safety system, the device including a first member having an inner wall defining a recess, the inner wall terminating at two sides to define a first opening. The device further includes a second member received in the recess of the first member, the second member being slidable relative to the first member to facilitate movement of the device between a locked condition and an unlocked condition. In the locked condition, the second member and a side of the inner wall define a second opening, the second opening being smaller than the first opening.

11 Claims, 4 Drawing Sheets

(52) U.S. Cl.
CPC ..... *A62B 35/0075* (2013.01); *A62B 35/0087* (2013.01); *E04G 21/329* (2013.01); *E04G 21/3261* (2013.01); *E04G 21/3295* (2013.01)

(56) References Cited

U.S. PATENT DOCUMENTS

| | | | | |
|---|---|---|---|---|
| 6,488,118 | B1 * | 12/2002 | Corriveau ..... | A62B 35/0056 104/111 |
| 7,347,300 | B2 * | 3/2008 | Renton ..... | A62B 35/0056 182/3 |
| 8,001,904 | B2 * | 8/2011 | Maes ..... | A62B 35/0087 104/112 |
| 9,186,530 | B2 * | 11/2015 | Jones ..... | A62B 35/0087 |
| 9,504,861 | B2 * | 11/2016 | Jones ..... | A62B 35/0081 |
| 2010/0294590 | A1 | 11/2010 | Bodnar et al. | |
| 2011/0297480 | A1 | 12/2011 | Jones et al. | |
| 2014/0318890 | A1 | 10/2014 | Vogels | |

OTHER PUBLICATIONS

International Examining Authority, International Preliminary Report on Patentability for PCT/AU2016/050790, including Applicant's Mar. 8, 2017 response to ISA's Nov. 28, 2016 Written Opinion , dated Jul. 3, 2017, 18 pages, Australian Patent Office, Australia.

Safetylink, "Frogline Lifeline Shuttle", brochure, retrieved from <http://www.heightsafety.com/files/Product%20sheets/Staticline%20System/Shuttle%20 Staticline/PSH-STAT.SHUTL003.pdf>, undated, 3 pages, The International Searching Authority was unable to establish the publication date.

* cited by examiner

SHUTTLE DEVICE

CROSS REFERENCE TO RELATED APPLICATIONS

This application is a National Stage Application, filed under 35 U.S.C. § 371, of International Application No. PCT/AU2016/050790, filed Aug. 26, 2016, which claims priority to Australian Application No. 2015903497, filed Aug. 28, 2015; the contents of both of which are hereby incorporated by reference in their entirety.

BACKGROUND

Related Field

Technical Field

The invention described herein relates to a shuttle device. In particular, the invention is directed to a shuttle device for connecting a user to a height safety or fall arrest system.

Description of Related Art

Reference to prior art disclosures in this specification is not an admission that the disclosures constitute common general knowledge.

In industries such as the construction industry, it is often necessary for workers to be working at heights. For example, on roofs, ledges, scaffolds, ladders and mezzanine floors. Worker safety is an important consideration as falls from height can leave workers with permanent and debilitating injuries.

Various height safety equipment exist to mitigate these risks for workers working from heights. For example, a height safety line system can be used on a roof to protect a worker from serious injury in the event of a falling incident. The safety line system typically includes a number of anchors secured to the roof, and a cable secured to the anchors. A lanyard attached to a harness worn by a worker can be linked to the cable via a shuttle device. Occasionally, a shock absorber device is used with the lanyard to facilitate shock absorption in the event of a fall. The static line system therefore provides a means to prevent the worker from hitting the ground in the event of a fall.

The shuttle device is connectable to and movable along the cable of the safety line system. The shuttle device thereby connects the worker to the safety line system and provides the worker with sufficient mobility to move around the worksite. Current shuttle devices typically involve internal mechanism which allow the shuttle to lock and unlock for attachment to and detachment from the cable. However, some shuttle devices can be costly and complex to manufacture, which can often result in errors in the manufacturing process. Defected shuttle devices can undesirably cause malfunctioning of the height safety system and thereby endangering workers. Some shuttle devices can also be complex to use, which can undesirably lead to operational errors.

Embodiments of the present invention provide an improved shuttle device for connecting a user to a height safety system, which overcomes or ameliorates one or more of the disadvantages or problems described above, or which at least provides the consumer with a useful choice.

BRIEF SUMMARY

According to a first aspect of the invention, there is provided a shuttle device for a height safety system, the device including a first member having an inner wall defining a recess, the inner wall terminating at two sides to define a first opening, and a second member received in the recess of the first member, the second member being slidable relative to the first member to facilitate movement of the device between a locked condition and an unlocked condition, wherein in the locked condition the second member and a side of the inner wall define a second opening, the second opening being smaller than the first opening.

Advantageously, the sliding of the second member relative to the first member to facilitate movement the shuttle device between locked and unlocked conditions greatly simplifies the operation and manufacture of the shuttle mechanism. In use, the shuttle device has a mouth for receiving a cable of the height safety system therethrough. The size of the mouth is adjustable by movement of the first and second members relative to one another. In the unlocked condition, the mouth is widened to allow insertion of the cable, and in the locked condition, the mouth is narrowed so as to prevent the cable from passing through the opening.

The relative sliding movement may include linear and/or non-linear movement. For example, the second member may be rotatable relative to the first member to facilitate movement of the device between locked and unlocked conditions. In one embodiment, the second member is configured to translate and rotate relative to the first member to move the device between locked and unlocked conditions.

The shuttle device may further include a guiding mechanism to guide the relative movement between the first and second members. For example, the guiding mechanism may allow the first and second members to move relative to one another according to a defined path. In one embodiment, the first member may include a guide arm for movement within a guide slot of the second member. Alternatively, the second member may include a guide arm for movement within a guide slot of the first member.

The guide mechanism may have one or more translation portions for guiding the translation of the second member relative to the first member. The guide mechanism may have one or more rotation portions for guiding the rotation of the second member relative to the first member. Typically, the guide slot may be generally C-shaped so as to guide the second member through a combination of rotation and translation movement relative to the first member.

The shuttle device may have more than one locked condition and more than one unlocked condition. In one embodiment, the second member may be slidable relative the first member towards one direction to facilitate movement of the shuttle device from a locked condition to a first unlocked condition. In addition, the second member may be slidable relative the first member towards an opposite direction to facilitate movement of the shuttle device from the locked condition to a second unlocked condition. The first and second members may be symmetrical to allow the shuttle device to be unlocked via movement of the second member relative to the first member in either one of two opposite directions.

The guide mechanism may further include opposing stepped portions for guiding the relative movement between the first and second members. The first member may have a first stepped portion for engagement with a second stepped portion of the second member.

Each stepped portion may include a projection. In the locked condition, the projection of each stepped portion may abut one another. In the one or more unlocked conditions, the projections may be disposed adjacent one another.

The first and second members may each have a body member having C-shaped cross section and a longitudinal axis. An outer surface of the second member may be shaped to generally correspond with the inner wall of the first member.

Each body member defining a recess and an opening through which the recess is accessible, each opening having a first side and a second side. When the body member of the second member is received within the recess of the body member of the first member, the first side of the first member is generally parallel with the first side of the second member, and the second side of the first member is generally parallel with the second side of the second member. When the second member is received within the first member, the first side of the first member forms the second opening (or mouth) with the second side of the second member. The size of the mouth is adjustable by relative movement between the first and second members.

To move from a locked condition to an unlocked condition, the second member translates and rotates about the longitudinal axis such that the second side of the second member is moved away from the first side of the first member to thereby widen the second opening. To move from the unlocked condition to a locked condition, the second member rotates about the longitudinal axis and translates relative to the first member such that the second side of the second member is moved closer to the first side of the first member to thereby narrow the second opening.

Each of the first and second members may include an attachment portion for attaching a connection device such as a carabiner or a quicklink device thereto. Each attachment portion may define an aperture for receiving a carabiner therethrough. When the shuttle device is in the locked condition, the apertures may be aligned to receive a carabiner therethrough. The carabiner may prevent the shuttle device from being inadvertently dislodged into an unlocked position when the carabiner is received in the apertures.

The first member may further include a weighted portion for biasing the shuttle device in a desired position during operation. The weighted portion may be provided on a side of the first member opposite the attachment portion such that in the desired position, the second opening is facing downwardly so as to allow the shuttle device to bypass anchors of the height safety system.

In order that the invention may be more readily understood and put into practice, one or more preferred embodiments thereof will now be described, by way of example only, with reference to the accompanying drawings.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristic described herein may be combined in any suitable manner in one or more combinations.

DETAILED DESCRIPTION OF PREFERRED EMBODIMENTS

Figure 1:
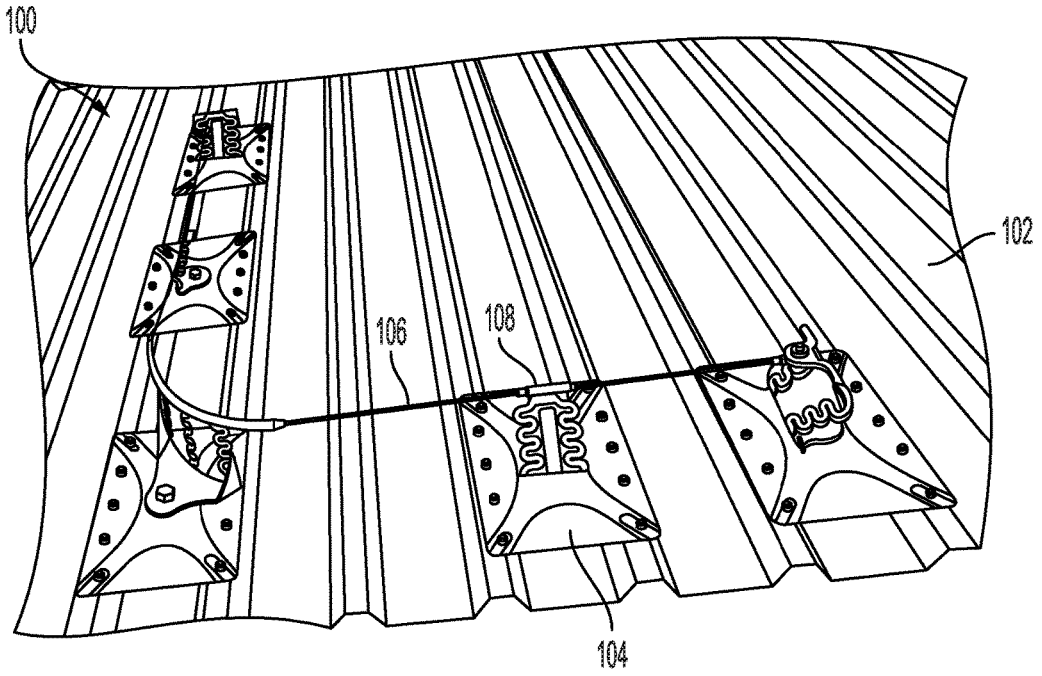
FIG. 1 illustrates a static line system as an example height safety system.

A static line height safety system 100 is shown in FIG. 1. The static line system 100 is secured to an elevated worksite, such as a roof 102. The static line system 100 includes a plurality of anchors 104 for mounting to the roof 102 and a cable 106 connecting the anchors 104. The cable 106 is attached to each anchor 104 via a cable attachment portion 108. The cable attachment portion 108 typically includes a sleeve for receiving a portion of the cable 106 therethrough.

Figure 2:
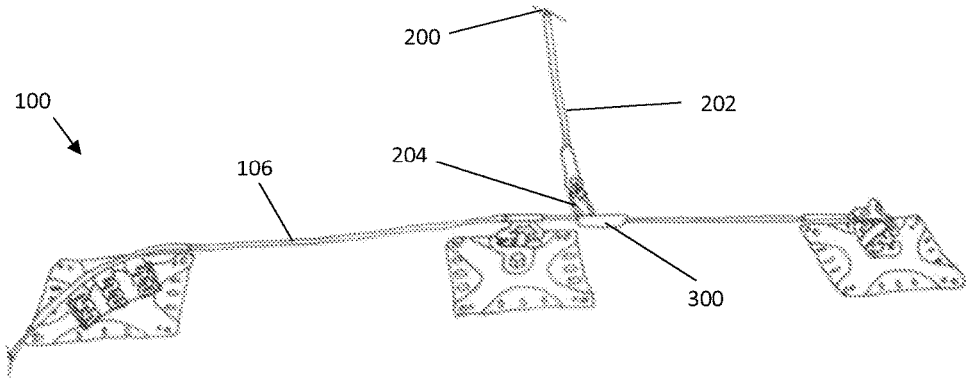
FIG. 2 illustrates a shuttle device connecting a user to the static line system of FIG. 1.

As shown in FIG. 2, a worker 200 (not shown) is attached to the static line system 100 via a lanyard 202, a carabiner or quicklink 204 and a shuttle device 300. The shuttle device 300 is secured to the cable 106. The device 300 is movable along the cable 106, and is capable of passing over the cable attachment portions 108 so as to be movable along the cable 106 from end to end. The shuttle device 300 thereby connects the worker 200 to the static line system 100 and allows the worker 200 to safely move about the elevated worksite within the confines of the static line system 100. In the event of a fall, the worker 200 will remain safely attached to the static line system 100 via the shuttle device 300, thereby preventing the worker 200 from serious injury.

Figure 3:
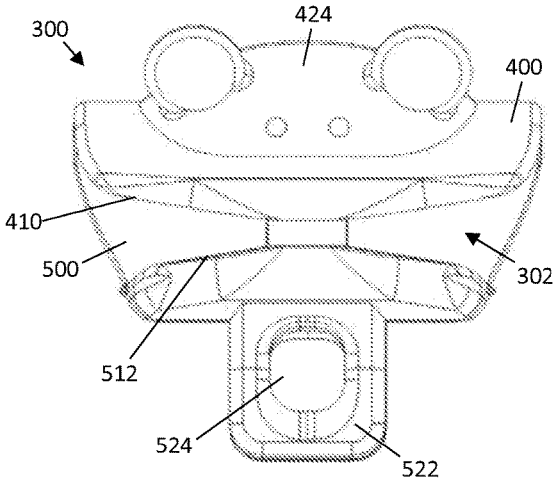
FIG. 3 is a front view of a shuttle device according to an embodiment of the present invention.
Figure 4:
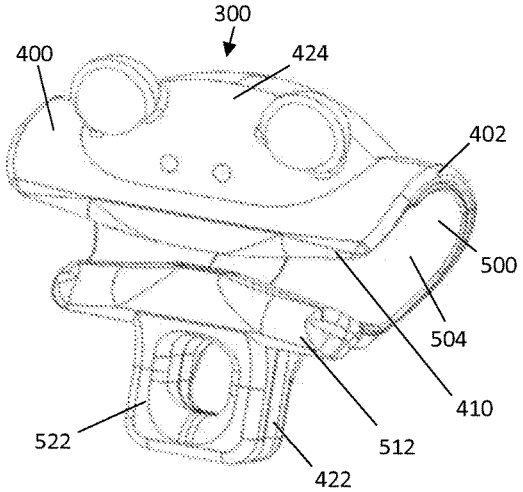
FIG. 4 is a perspective view of the shuttle device shown in FIG. 3.
Figure 5:
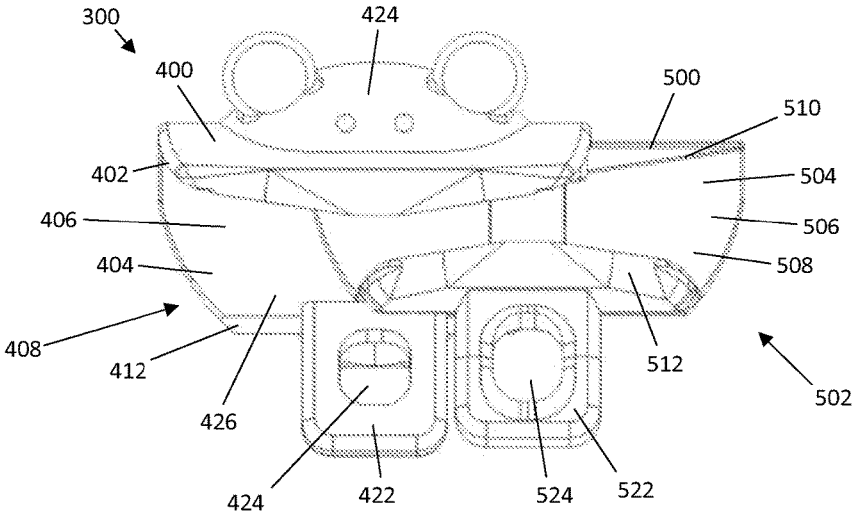
FIG. 5 is a further front view of the shuttle device of FIGS. 3 and 4, showing displacement of the second member relative to the first member to unlock the shuttle device.

As more clearly shown in FIGS. 3 to 5, the shuttle device 300 includes a first member 400 and a second member 500. The first member 400 has an elongate body 402 having a generally C-shaped cross section. The body 402 has an inner wall 404 defining a recess 406. The inner wall 404 terminates at first and second sides 410, 412 of the recess 406 to define an opening 408 of the first member 400.

Figure 6:
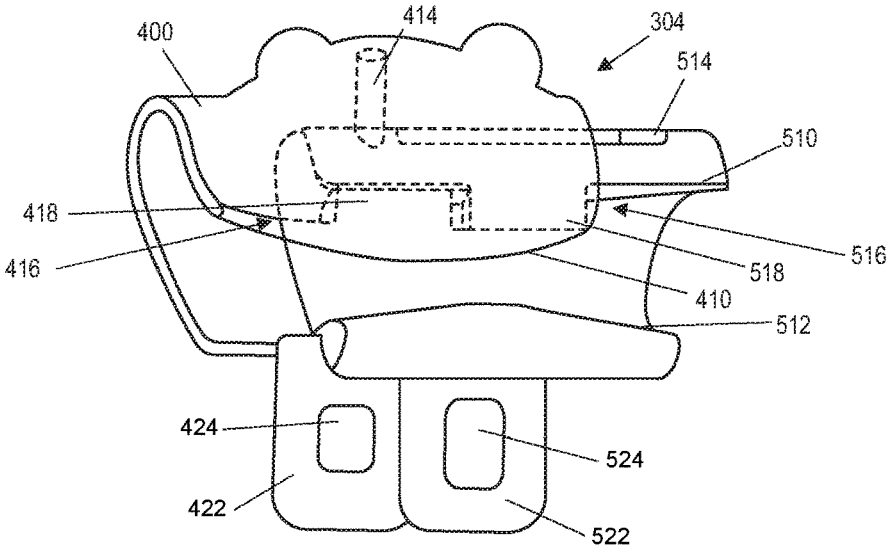
FIG. 6 is a further perspective view of the shuttle device of FIGS. 3 to 5, in which the first member is semi-transparent to illustrate the interaction between the first and second members during operation.

As more clearly shown in FIGS. 5 and 6, the second member 500 also has an elongate body 502 having a generally C-shaped cross section. The body 502 also has an inner wall 504 defining a recess 506. The inner wall 504 terminates at first and second sides 510, 512 of the recess 506 to define an opening 508 of the second member 500.

When the body 502 of the second member 500 is received within the recess 406 of the first member 400, the first side 410 of the first member 400 and the second side 512 of the second member 500 form a mouth (or second opening) 302. The mouth 302 is narrower than the opening 408 of the first member 400, as well as the opening 508 of the second member 500.

The shuttle device 300 is movable between a locked condition (see FIGS. 3 and 4) in which the shuttled device 300 is securely attached to the cable 106 of the static line system 100, and an unlocked condition (see FIGS. 5 and 6)

in which the shuttle device is attachable to, or removable from the cable 106 of the static line system 100.

The second member 500 is slidable relative to the first member 400 so as to move the shuttle device 300 between its locked and unlocked conditions. In particular, the second member 500 is configured to linearly translate and rotate relative to the first member 400 to vary the size of the second opening 302 to thereby move the shuttle device 300 between locked and unlocked conditions. This will be explained in further detail below.

Figure 7:
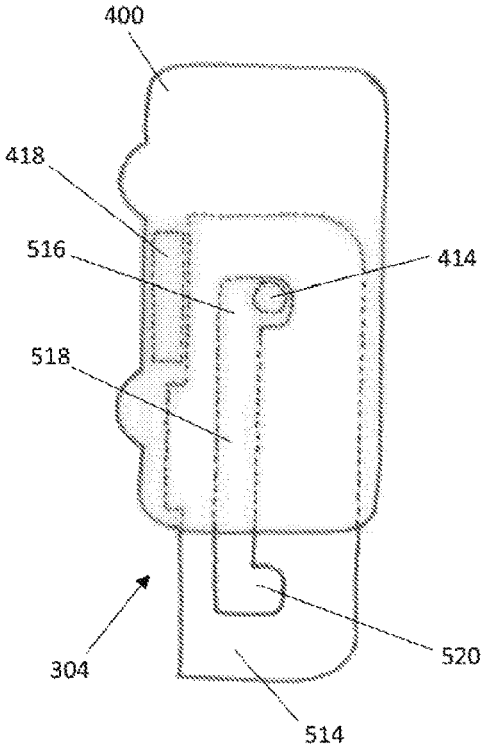
FIG. 7 is a top view of the shuttle device of FIGS. 3 to 6, in which the first member is semi-transparent to illustrate the guide mechanism.

Now referring to FIGS. 6 and 7 in which the first member 400 is semi-transparent for illustrative purposes only. The shuttle device 300 further includes a guiding mechanism 304 to guide the relative movement between the first and second members 400, 500. In particular, the first member 400 includes a guide arm 414 and the second member 500 includes a generally C-shaped guide slot 514. The guide arm 414 moves along the generally C-shaped defined path of the guide slot 514 to guide the movement of the second member 500 relative to the first member 400.

Elaborating further, the C-shaped guide slot 514 includes three portions—a first rotation portion 516 in which movement of the guide arm 414 therein causes rotation of the second member 500 about its longitudinal axis relative to the first member 400; a second translation portion 518 in which movement of the guide arm 414 therein causes lateral translation of the second member 500 relative to the first member 400; and a third rotation portion 520 in which movement of the guide arm 414 therein causes rotation of the second member 500 about its longitudinal axis relative to the first member 400 (see FIG. 7).

When the shuttle device 300 is in the locked condition, the guide arm 414 is located midway in the second translation portion 518. When moving from a locked condition to an unlocked condition, a pulling force in a longitudinal direction of the body 502 causes the second member 500 to laterally translate relative to the first member 400 and the guide arm 414 to move along the second translation portion 518 of the guide slot 514 towards either rotation portion 516, 514. Once the guide arm 414 is moved into either rotation portion 516, 514, the second member 500 is rotated about its longitudinal axis relative to the first member 400 until the guide arm 414 reaches an end of the rotation portion 516, 514 (FIGS. 6, 7). The rotation of the second member 500 relative to the first member 400 moves the second side 512 of the opening 508 further away from the first side 410 of the opening 408 of the first member 400, thereby widening the mouth 302 to allow insertion or removal of a height safety system 100 cable 106.

The guiding mechanism 304 therefore allows the first and second members 400, 500 to move relative to one another according to a defined path. The guiding mechanism 304 also prevents the two members 400, 500 from becoming inadvertently separated. However, it will be understood that the shuttle device 300 is capable of carrying out the desired function if the two members 400, 500 were separable.

As more clearly shown in FIG. 6, the first member 400 includes an internal stepped portion 416 for interaction with an external stepped portion 516 of the second member 500. Each stepped portion 416, 516 includes a projection 418, 518. When the shuttle device 300 is in the locked condition, the projections 418, 518 abut one another so as to facilitate holding the second member 500 in the correct position relative to the first member 400. When the shuttle device is in the unlocked condition, the projections 418, 518 are disposed adjacent one another (see FIG. 6) to further facilitate holding the second member 500 in the correct position relative to the first member 400.

Figure 8:
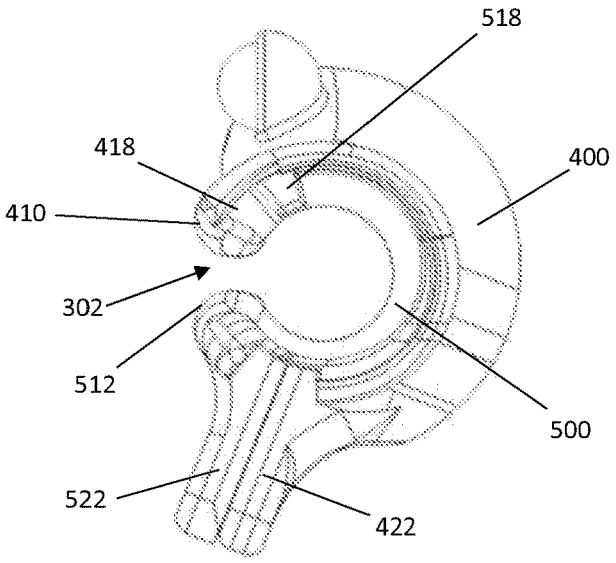
FIG. 8 is a side view of the shuttle device of FIGS. 3 to 7, in which the shuttle device is in a locked condition.

FIG. 8 is a side view of the shuttle device 300 in the locked condition. As shown in FIG. 8, the internal projection 418 of the first member 400 abuts the external projection 518 of the second member 500. In the locked condition, the second side 512 of the second member 500 is positioned relatively close to the first side 410 of the first member 400 such that the mouth 302 of the shuttle device 300 is locked in narrowed condition. The size of the mouth 302 when the shuttle device 300 is locked is configured such that a cable 106 of the height safety system 100 cannot pass through it. However, the recess 506 and the mouth 302 is suitably sized to allow the device 300 to bypass the anchors 104 and cable attachment portions 108.

Figure 9:
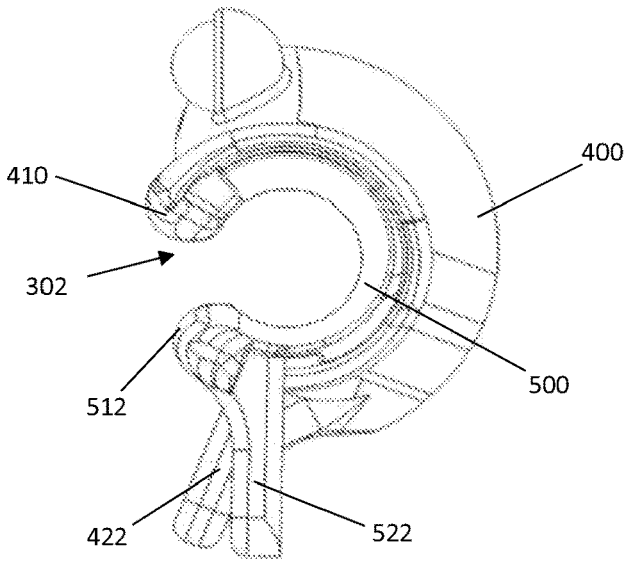
FIG. 9 is a further side view of the shuttle device of FIGS. 3 to 8, in which the shuttle device is in an unlocked condition.

FIG. 9 is a side view of the shuttle device 300 in an unlocked condition. As shown in FIG. 9, the external projection 518 of the second member 500 is positioned adjacent the internal projection 418 of the first member 400 (hidden). In the unlocked condition, the second side 512 of the second member 500 is positioned further away from the first side 410 of the first member 400 such that the mouth 302 of the shuttle device 300 is widened. The size of the mouth 302 when the shuttle device 300 is unlocked is configured such that a cable 106 of the height safety system 100 can pass through it. However, the recess 506 and the mouth 302 is suitably sized to allow the cable 106 to pass through it so that the shuttle device 300 can be attached to or removed from the height safety system 100.

As previously discussed, the shuttle device 300 has two unlocked conditions. The second member 500 can be moved laterally relative to the first member 400 in either direction to arrive at the unlocked condition. For instance, with reference to FIG. 6, the second member 500 is moved towards the right side of the first member 400. The second member 500 can also be moved towards the left side of the first member 400 to arrive at the unlocked condition.

As shown in FIGS. 3 to 9, each of the first and second members 400, 500 includes a respective attachment portion 422, 522. Each attachment portion 422, 522 defines an aperture 424, 524 for attaching a carabiner 204 therethrough. When the shuttle device 300 is in the locked condition, the apertures 424, 524 are aligned as shown in FIG. 3 to receive a carabiner 204 therethrough (FIGS. 3, 4 and 8).

When the carabiner 204 is secured through the apertures 424, 524, the carabiner 204 ensures that the two members 400, 500 cannot become dislodged and inadvertently moved to unlock the shuttle device 300 during use. The operation of the attachment portions 422, 522 together with the carabiner 204 advantageously provides operational security to ensure safe operation of the shuttle device 300.

When unlocking the shuttle device 300, the attachment portions 422, 522 move out of alignment so as to allow rotation of the second member 500 about its longitudinal axis relative to the first member 400 (FIGS. 6 and 9).

The first member 400 further includes a weighted portion 424 for biasing the shuttle device 300 in a desired position during operation. In the embodiment shown in FIGS. 3 to 9, the weighted portion is shaped like a frog's head for visual appeal. However, it will be understood that the weighted portion 424 can take any suitable shape and form.

The weighted portion 424 is provided on a side of the first member 400 opposite the attachment portion 422 such that in the locked condition during use, the weighted portion 424 ensures that the mouth 302 typically faces downwardly so as to allow the shuttle device 300 to easily bypass anchors 104 of the height safety system 100.

During operation, a worker 200 can secure himself/herself to a height safety system 100 by using a shuttle device 300 as described herein. Firstly, the shuttle device 300 is moved from a locked to an unlocked condition by sliding the second member 500 relative to the first member 400. The second member 500 can be moved in either lateral direction relative to the first member 400. Firstly, the second member 500 translates laterally relative to the first member 400 so that guide arm 414 moves from a central location in the guide slot 514 to one side of the translation portion 516 of the guide slot. Then, the second member 400 is rotated about its longitudinal axis relative to first member 500 so that the guide arm 414 moves from one end of a rotation portion 414, 514 to an opposite end (FIG. 7).

At the same time, the projections 418, 518 move from an abutting position in the locked condition (FIG. 8) to a side-by-side position in the unlocked condition (FIG. 6, 9). The size of the mouth 302 is enlarged as the second side 512 is moved further away from the first side 410 (FIG. 9) to allow the cable 106 of the height safety system 100 to pass through.

Once the cable 106 is securely inserted into recess 506 of the second member 500, the shuttle device 300 can be locked by reversing the relative rotation and translation movement described above. Once in the locked condition, the second side 512 is moved closer to the first side 410 so as to reduce the side of mouth 302 to prevent the cable 106 from passing through the mouth 302 (FIG. 8).

In the locked condition, the attachment portions 522, 422 and respective apertures 424, 524 become aligned (FIGS. 3, 4, 8). The worker 200 can then attach a carabiner 204 through the apertures 424, 524. The carabiner 204 is attached to a lanyard 202 which can be tied or otherwise connected via a connecting device to a harness (not shown) worn by the worker 200. The carabiner 204 attached through the apertures 424, 524 ensures that the shuttle device 300 remains in the locked condition until the shuttle device 300 unlocked.

To unlock the shuttle device 300 so that the worker 200 can be removed from the height safety system 100 at the end of a job, the carabiner 204 is simply removed from the apertures 424, 524. The shuttle device 300 can also optionally be removed from the system 100 by unlocking the device 300 in the manner previously described.

The simple construction of the shuttle device 300 makes the device 300 cost effective and simple to manufacture. The operating simplicity also avoids errors in the manufacturing and assembly process. In addition, the simple operation of the device 300 reduces the risk of misuse.

In one alternative embodiment, the first and second members 400, 500 can be moved between a locked and unlocked condition by lateral translation alone. For example, the two members 400, 500 may be separable to unlock and combined to lock. When separated, the cable 106 may be passed through the opening 508 of the second member 500. To lock the device 300, the second member 500 can be inserted in the recess 406 of the first member 400 by lateral translation such that the first member 400 covers a portion of the opening 508 to thereby create a smaller mouth 302 to prevent the cable 106 from escaping the recess 406. In this embodiment, no relative rotation between the first and second members 400, 500 are required.

The foregoing embodiments are illustrative only of the principles of the invention, and various modifications and changes will readily occur to those skilled in the art. The invention is capable of being practiced and carried out in various ways and in other embodiments. It is also to be understood that the terminology employed herein is for the purpose of description and should not be regarded as limiting.

The term "comprise" and variants of that term such as "comprises" or "comprising" are used herein to denote the inclusion of a stated integer or integers but not to exclude any other integer or any other integers, unless in the context or usage an exclusive interpretation of the term is required.

The claims defining the invention are as follows:

1. A shuttle device for a height safety system, the device comprising:

a first member having a guide arm and an inner wall, the inner wall defining a recess and terminating at two sides to define a first opening, and second member having a guide slot and being received in the recess of the first member, the second member being slidable and rotatable relative to the first member via engagement of the guide arm with the guide slot, the engagement being configured to facilitate movement of the device between a locked condition and at least first and second unlocked conditions, the guide arm and the guide slot collectively defining a guide mechanism, wherein:

in the locked condition the second member and a side of the inner wall define a second opening, the second opening being smaller than the first opening, the guide slot comprises opposing closed-end portions and an elongate portion intermediate the opposing closed-end portions, the elongate portion extending along a primary guide slot axis, the opposing closed-end portions extending perpendicular to the primary guide slot axis, the guide arm is slidable along the elongate portion of the guide slot in a first direction and slidable along one of the opposing closed-end portions to facilitate movement of the shuttle device from the locked condition to the first unlocked condition, and the guide arm is slidable along the elongate portion of the guide slot in a second direction opposite the first direction and slidable along the other of the opposing closed-end portions to facilitate movement of the shuttle device from the locked condition to the second unlocked condition.

2. The shuttle device according to claim 1, wherein the guide slot is generally C-shaped so as to guide the second member, via the engagement of the guide arm of the first member with the guide slot of the second member, through a combination of rotation and translation movement relative to the first member.

3. The shuttle device according to claim 1, wherein the guide mechanism further includes opposing stepped portions for guiding the relative movement between the first and second members.

4. The shuttle device according to claim 3, wherein said opposing stepped portions include a first stepped portion on the first member for engagement with a second stepped portion on the second member.

5. The shuttle device according to claim 4, wherein:

each stepped portion includes a projection, in the locked condition, the projection of each stepped portion abut one another, and in the first and second unlocked conditions, the projections are disposed adjacent one another.

6. The shuttle device according to claim 1, wherein the first and second members each have a body member having a generally C-shaped cross section and a longitudinal axis.

7. The shuttle device according to claim 6, wherein:

the second body member defining a recess and an opening through which the recess is accessible, said opening having a first side and a second side;

the second member translates and rotates about its longitudinal axis such that the second side of the second member is moved away from the first side of the first member to thereby widen the second opening so as to move from the locked condition to the first or the second unlocked condition, and the second member rotates about its longitudinal axis and translates relative to the first member such that the second side of the second member is moved closer to the first side of the first member to thereby narrow the second opening so as to move from the first or the second unlocked condition to the locked condition.

8. The shuttle device according to claim 1, wherein each of the first and second members includes an attachment portion for attaching a connection device thereto.

9. The shuttle device according to claim 8, wherein the connection device is a carabiner or a quick-link device.

10. The shuttle device according to claim 8, wherein:

each attachment portion defines an aperture for receiving the connection device there-though, and when the shuttle device is in the locked condition, the apertures are aligned to receive the connection device, such that the connection device may prevent the shuttle device from being inadvertently dislodged into the first or the second unlocked position when the connection device is received in the apertures.

11. The shuttle device according to claim 1, wherein the first member includes a weighted portion for biasing the shuttle device in a desired position in which the second opening is facing downwardly so as to allow the shuttle device to bypass anchors of the height safety system.

* * * * *